US009926678B2

(12) United States Patent
Vogel

(10) Patent No.: US 9,926,678 B2
(45) Date of Patent: Mar. 27, 2018

(54) FLEXIBLE SCREED

(71) Applicants: VOLVO CONSTRUCTION EQUIPMENT AB, Eskilstuna (SE); Lynn D. Vogel, Chambersburg, PA (US)

(72) Inventor: Lynn D. Vogel, Chambersburg, PA (US)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 0 days.

(21) Appl. No.: 15/023,558

(22) PCT Filed: Oct. 24, 2013

(86) PCT No.: PCT/US2013/066594

§ 371 (c)(1),
(2) Date: Mar. 21, 2016

(87) PCT Pub. No.: WO2015/060852

PCT Pub. Date: Apr. 30, 2015

(65) Prior Publication Data

US 2016/0208446 A1 Jul. 21, 2016

(51) Int. Cl.
*E01C 19/22* (2006.01)
*E01C 19/48* (2006.01)

(52) U.S. Cl.
CPC ..... *E01C 19/4873* (2013.01); *E01C 19/22* (2013.01); *E01C 2301/16* (2013.01)

(58) Field of Classification Search
CPC ... E01C 19/22; E01C 19/4866; E01C 19/4873
(Continued)

(56) References Cited

U.S. PATENT DOCUMENTS 1,371,839 A * 3/1921 Bartell ..... E02F 3/7631 172/619
2,235,105 A 5/1939 Heltzel
(Continued)

FOREIGN PATENT DOCUMENTS

JP 2008038487 A 2/2008

OTHER PUBLICATIONS

International Search Report (dated Mar. 21, 2014) for corresponding International App. PCT/US2013/066594.
(Continued)

*Primary Examiner* — Thomas B Will
*Assistant Examiner* — Katherine J Chu
(74) *Attorney, Agent, or Firm* — Michael Pruden; Martin Farrell

(57) ABSTRACT

The present invention relates to a screed for a paving machine that includes a flexible smoothing plate, a vertex block a first actuator, and a second actuator. The flexible smoothing plate is provided with a longitudinal length and an outer longitudinal end. The vertex block is located on top of the flexible smoothing plate. The first actuator is connected to the outer longitudinal end and adapted to selectively adjust an elevation of the outer longitudinal end so that the outer longitudinal end of the flexible smoothing plate forms a berm by flexing about the vertex block and extending upward at an angle relative to an inner portion of the flexible smoothing plate. The second actuator is connected to the vertex block and configured to adjust the length of the berm by selectively repositioning the vertex block along the longitudinal length of the flexible smoothing plate.

16 Claims, 9 Drawing Sheets

(58) Field of Classification Search
USPC ..... 404/96, 118
See application file for complete search history.

(56) References Cited

U.S. PATENT DOCUMENTS

| | | | | |
|---|---|---|---|---|
| 3,298,291 | A | 1/1967 | Layton | |
| 3,559,544 | A | 2/1971 | Miller | |
| 3,602,113 | A | 8/1971 | Davin et al. | |
| 3,636,831 | A * | 1/1972 | Davin | E01C 19/185 404/104 |
| 3,680,451 | A | 8/1972 | Birtchet | |
| 4,068,969 | A | 1/1978 | Beach et al. | |
| 4,364,690 | A | 12/1982 | Bruns | |
| 4,688,965 | A | 8/1987 | Smith et al. | |
| 4,818,140 | A * | 4/1989 | Carlson | E01C 19/4893 404/104 |
| 4,865,487 | A | 9/1989 | Lutz | |
| 5,308,190 | A * | 5/1994 | Raymond | E01C 19/48 404/118 |
| 5,344,254 | A * | 9/1994 | Sartain | E01C 19/48 404/104 |
| 5,533,831 | A * | 7/1996 | Allen | E01C 19/006 404/114 |
| 6,695,531 | B1 * | 2/2004 | Prescott | E01C 19/402 404/118 |
| 6,923,595 | B1 * | 8/2005 | Chek | E01C 19/402 15/235.4 |
| 6,984,089 | B1 | 1/2006 | Colvard | |
| 7,261,491 | B2 * | 8/2007 | Rahn | E01C 19/48 404/104 |
| 7,357,597 | B2 * | 4/2008 | Face, III | E01C 19/42 404/118 |
| 7,909,534 | B1 | 3/2011 | Comer et al. | |
| 8,221,026 | B2 * | 7/2012 | Munz | E01C 19/48 404/118 |
| 8,297,879 | B1 * | 10/2012 | Schmidt | E01C 19/4873 172/811 |
| 8,517,630 | B2 | 8/2013 | Graham et al. | |
| 8,591,145 | B1 * | 11/2013 | Engel | E01C 19/48 404/104 |
| 8,864,410 | B1 * | 10/2014 | Kopacz | E01C 19/48 404/118 |
| 2002/0106243 | A1 * | 8/2002 | Rahn | E01C 19/4893 404/96 |
| 2005/0111914 | A1 | 5/2005 | Rahn et al. | |
| 2010/0150650 | A1 * | 6/2010 | Buschmann | E01C 19/48 404/82 |
| 2011/0013985 | A1 | 1/2011 | Antonelli | |
| 2012/0051839 | A1 | 3/2012 | Begley et al. | |
| 2012/0183350 | A1 | 7/2012 | Mittleman | |

OTHER PUBLICATIONS

Written Opinion (dated Mar. 21, 2014) for corresponding International App. PCT/US2013/066594.

* cited by examiner

FLEXIBLE SCREED

FIELD OF THE INVENTION

The present invention relates to a flexible screed for a paving machine.

BACKGROUND OF THE INVENTION

Paving extension screeds may include an outer end that is provided with a berm, which extends upward at an angle relative to an inner portion of the extension screed.

The inclusion of a berm on a screed is problematic for a number of reasons. Inclusion of a berm introduces higher costs in the form of machining due to lower tolerances and more complex mechanical design, since the berm must be able to pivot and hold a desired angle, while at the same time being seamlessly connected to the inner portion of the extension screed. Another problem is that the length of the berm is not adjustable. Where variation in the berm length is desired, this necessitates the use multiple extension screeds with berms of different lengths.

The present invention relates to a flexible screed for a paving machine, wherein a berm may be provided and the berm length and angle are variable.

SUMMARY OF THE INVENTION

According to one embodiment of the present invention, a screed for a paving machine includes a flexible smoothing plate, a vertex block, a first actuator, and a second actuator. The flexible smoothing plate is provided with a longitudinal length and an outer longitudinal end. The vertex block is located on top of the flexible smoothing plate. The first actuator is connected to the outer longitudinal end and adapted to selectively adjust an elevation of the outer longitudinal end so that the outer longitudinal end of the flexible smoothing plate forms a berm by flexing about the vertex block and extending upward at an angle relative to an inner portion of the flexible smoothing plate. The second actuator is connected to the vertex block and configured to adjust the length of the berm by selectively repositioning the vertex block along the longitudinal length of the flexible smoothing plate.

According to another embodiment of the present invention, a method for providing a berm configuration on a screed of a paving machine provided with a flexible smoothing plate that includes a longitudinal length and an outer longitudinal end, a vertex block on top of the flexible smoothing place, a first actuator connected to the outer longitudinal end of the flexible smoothing plate, and a second actuator connected to the vertex block includes the steps of using the first actuator to selectively adjust an elevation of the outer longitudinal end so that the outer longitudinal end of the flexible smoothing plate forms a berm by flexing about the vertex block and extending upward at an angle relative to an inner portion of the flexible smoothing plate and using the second actuator to selectively reposition the vertex block along the longitudinal length of the flexible smoothing plate to adjust a length of the berm.

ASPECTS OF THE INVENTION

According to one aspect of the present invention, a screed for a paving machine comprises a flexible smoothing plate provided with a longitudinal length and an outer longitudinal end, a vertex block located on top of the flexible smoothing plate, a first actuator connected to the outer longitudinal end and adapted to selectively adjust an elevation of the outer longitudinal end so that the outer longitudinal end of the flexible smoothing plate forms a berm by flexing about the vertex block and extending upward at an angle relative to an inner portion of the flexible smoothing plate, and a second actuator connected to the vertex block that is configured to adjust a length of the berm by selectively repositioning the vertex block along the longitudinal length of the flexible smoothing plate.

Preferably, the flexible smoothing plate includes a plurality of plates that are provided as a stacked configuration.

Preferably, the screed for a paving machine further comprises a frame member and the flexible smoothing plate includes a plurality of plates that are provided as a stacked configuration, the plurality of stacked plates include a base plate and another plate, the base plate includes a plurality of retention studs that extend upward through orifices in the another plate so that the retention studs secure the flexible smoothing plate to the another plate with the aid of fasteners, and the another plate includes another plurality of retention studs that extend upward thorough orifices in the frame member so that the another plurality of retention studs secure the another plate and the base plate to the frame member with the aid of fasteners.

Preferably, the screed for a paving machine further comprises a frame member and the flexible smoothing plate includes a plurality of plates that are provided as a stacked configuration, the plurality of stacked plates include a base plate and another plate, the base plate includes a plurality of retention studs that extend upward through orifices in the another plate so that the retention studs secure the flexible smoothing plate to the another plate with the aid of fasteners, the another plate includes another plurality of retention studs that extend upward thorough orifices in the frame member so that the another plurality of retention studs secure the another plate and the base plate to the frame member with the aid of fasteners, and the orifices on the another plate include an orifice located on the outer longitudinal end that is dimensioned to accommodate relative longitudinal displacement between the plurality of stacked plates as outer longitudinal end flexes upward.

Preferably, the flexible smoothing plate may be provide with a berm configuration, whereat the outer longitudinal end extends upward at an angle relative to the inner portion; and the flexible smoothing plate may be provide with a non-berm configuration, whereat the outer longitudinal end is substantially co-planar with the inner portion.

Preferably, the first actuator is a linear actuator that allows slight incremental adjustments to the angle of the berm Preferably, the second actuator is a linear actuator that allows slight incremental adjustments to a position of the vertex block.

Preferably, the screed for a paving machine further comprises another outer longitudinal end on the flexible smoothing plate, another vertex block located on top of the flexible smoothing plate, another first actuator connected to the another outer longitudinal end and adapted to selectively adjust an elevation of the another outer longitudinal end so that the another outer longitudinal end of the flexible smoothing plate forms a berm by flexing about the another vertex block and extending upward at an angle relative to the inner portion of the flexible smoothing plate, and another second actuator connected to the another vertex block and adapted to selectively reposition the another vertex block along the longitudinal length of the flexible smoothing plate in order to adjust the length of the berm.

According to another aspect of the present invention, a method for providing a berm configuration on a screed of a paving machine provided with a flexible smoothing plate that includes a longitudinal length and an outer longitudinal end, a vertex block located on top of the flexible smoothing place, a first actuator connected to the outer longitudinal end of the flexible smoothing plate, and a second actuator connected to the vertex block comprises the steps of using the first actuator to selectively adjust an elevation of the outer longitudinal end so that the outer longitudinal end of the flexible smoothing plate forms a berm by flexing about the vertex block and extending upward at an angle relative to an inner portion of the flexible smoothing plate and using the second actuator to selectively reposition the vertex block along the longitudinal length of the flexible smoothing plate in order to adjust a length of the berm.

Preferably, the flexible smoothing plate includes a plurality of plates that are provided as a stacked configuration and the step of using the first actuator to selectively adjust the elevation of the outer longitudinal end so that the outer longitudinal end of the flexible smoothing plate forms the berm by flexing about the vertex block and extending upward at an angle relative to an inner portion of the flexible smoothing plate includes the step of flexing the plurality of plates about the vertex block.

Preferably, the screed for a paving machine further comprises a frame member, the flexible smoothing plate includes a plurality of plates that are provided as a stacked configuration, the plurality of stacked plates include a base plate and another plate, the base plate includes a plurality of retention studs that extend upward through orifices in the another plate so that the retention studs secure the flexible smoothing plate to the another plate with the aid of fasteners, the another plate includes another plurality of retention studs that extend upward thorough orifices in the frame member so that the another plurality of retention studs secure the another plate and the base plate to the frame member with the aid of fasteners, and the method further includes the step of using the first actuator to selectively adjust the elevation of the outer longitudinal end so that the outer longitudinal end of the flexible smoothing plate forms the berm by flexing about the vertex block and extending upward at an angle relative to an inner portion of the flexible smoothing plate includes the step of flexing the plurality of plates about the vertex block.

Preferably, the screed for a paving machine further comprises a frame member, the flexible smoothing plate includes a plurality of plates that are provided as a stacked configuration, the plurality of stacked plates include a base plate and another plate, the base plate includes a plurality of retention studs that extend upward through orifices in the another plate so that the retention studs secure the flexible smoothing plate to the another plate with the aid of fasteners, the another plate includes another plurality of retention studs that extend upward thorough orifices in the frame member so that the another plurality of retention studs secure the another plate and the base plate to the frame member with the aid of fasteners, the orifices on the another plate include an orifice located on the outer longitudinal end that is dimensioned to accommodate relative longitudinal displacement between the plurality of stacked plates as outer longitudinal end flexes upward, and the method further includes the step of using the first actuator to selectively adjust the elevation of the outer longitudinal end so that the outer longitudinal end of the flexible smoothing plate forms the berm by flexing about the vertex block and extending upward at an angle relative to an inner portion of the flexible smoothing plate includes the step of flexing the plurality of plates about the vertex block.

Preferably, the method further comprises the step of using the first actuator to selectively adjust the elevation of the outer longitudinal end so that the outer longitudinal end is provided with a non-berm configuration, whereat the outer longitudinal end is substantially co-planar with the inner portion.

Preferably, the first actuator is a linear actuator and the method further comprises the step of using the first actuator to make slight incremental adjustments to the angle of the berm Preferably, the second actuator is a linear actuator and the method further comprises the step of using the second actuator to make slight incremental adjustments to a position of the vertex block.

Preferably, the paving machine is provided with the flexible smoothing plate that includes another outer longitudinal end on the flexible smoothing plate, another vertex block located on top of the flexible smoothing plate, another first actuator connected to the another outer longitudinal end, and another second actuator connected to the another vertex block and the method further comprises the steps of using the another first actuator to selectively adjust an elevation of the another outer longitudinal end so that the another outer longitudinal end of the flexible smoothing plate forms a berm by flexing about the another vertex block and extending upward at an angle relative to the inner portion of the flexible smoothing plate; and using the another second actuator to selectively reposition the another vertex block along the longitudinal length of the flexible smoothing plate in order to adjust a length of the berm.

DETAILED DESCRIPTION OF THE INVENTION

Figure 1:
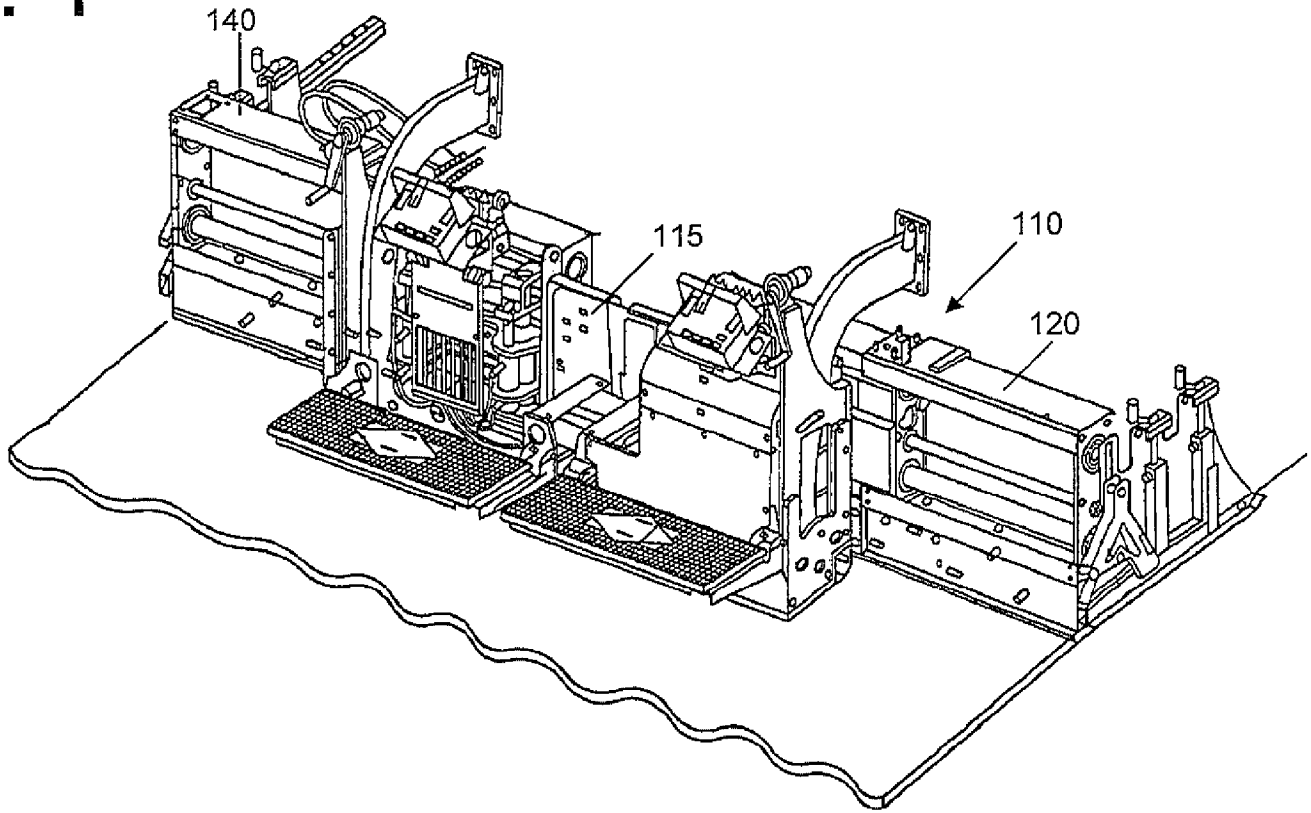
FIG. 1 PRIOR ART
FIG. 1 is a rear view of a prior art screed assembly having two extension screeds.
Figure 2:
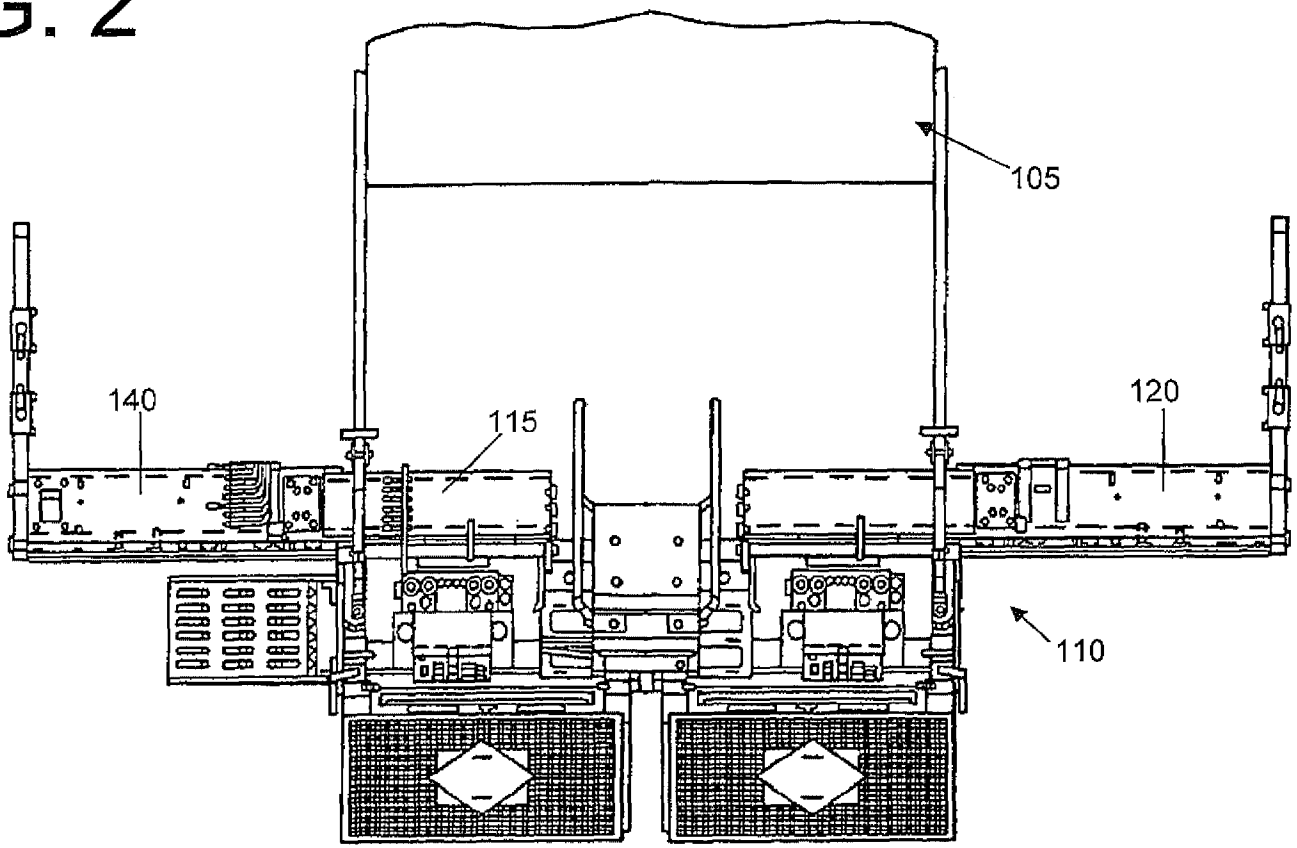
FIG. 2 PRIOR ART
FIG. 2 is a top view of a paving machine and a prior art screed assembly having two extension screeds.
Figure 3:
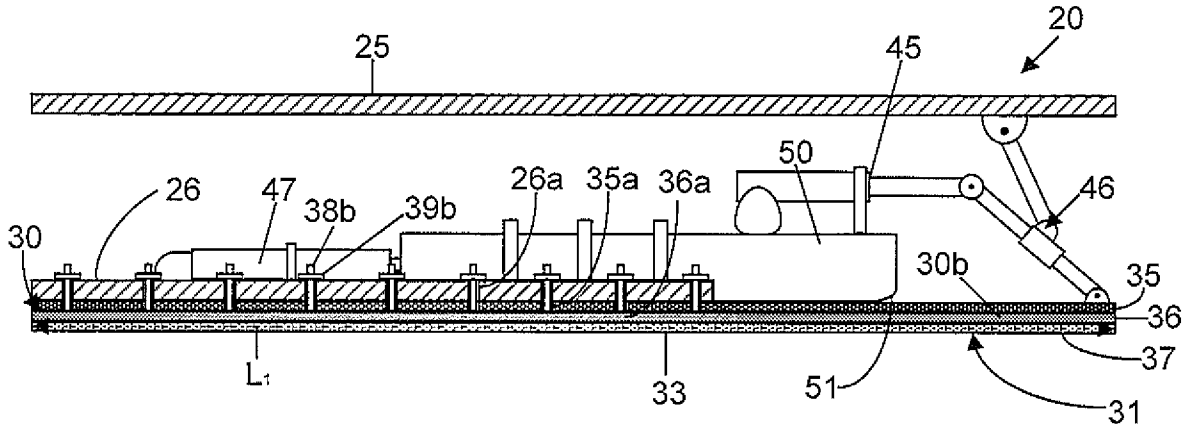
FIG. 3 depicts a side view of a screed extension, partially in section, according to one embodiment of the present invention.
Figure 4:
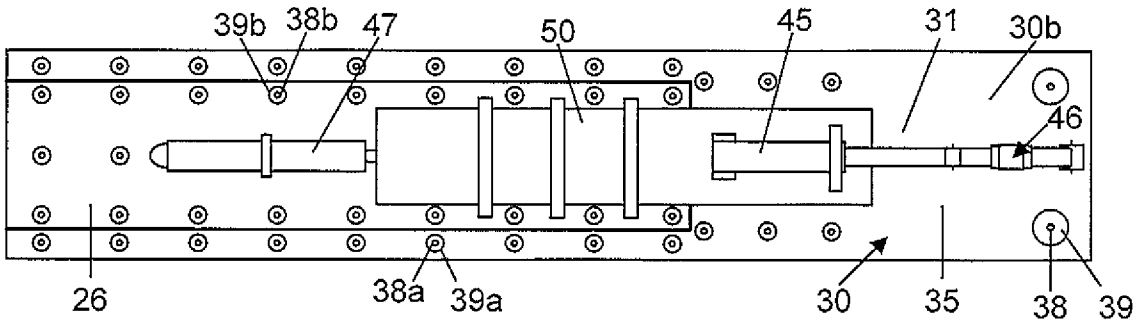
FIG. 4 depicts a top view of a screed extension in a first configuration, according to one embodiment of the present invention.

FIGS. 1 and 2 depict an example of a screed assembly 110 for a paving vehicle 105. As shown therein, the screed assembly 110 includes a centrally located main screed 115 and first and second extension screeds 120, 140. As shown, the first extension screed 120 is a right handed extension screed and the second extension screed 140 is a left handed extension screed. Those of ordinary skill in the art will appreciate that the extension screeds 120, 140 are moveably connected to the main screed 115, where by the first and second extension screeds 120, 140 may move outward relative to the main screed 115 to vary the width of a paving mat during a paving operation.

Turning now to FIGS. 3-6, an extension screed 20 according to one embodiment of the present invention is illustrated. For the purpose of teaching inventive principles, some conventional aspects have been simplified or omitted. Additionally, for sake of brevity and to avoid redundancy, FIGS. 3-6 only illustrate the right handed extension screed 20; however, those of ordinary skill in the art will appreciate that it is within the scope of the present invention to provide a screed assembly that includes a left handed extension screed that is a substantial mirror image of extension screed 20.

As shown in FIGS. 3-6, the extension screed 20 is provided with an upper frame member 25 and a lower frame member 26. Also shown, connected to the underside of the lower frame member 26 is a flexible smoothing plate 30 adapted to smooth out and typically minimally compact a paving material during a paving operation. The flexible screed includes a longitudinal length $L_1$ and an outer longitudinal end 31.

According to one aspect of the present embodiment the flexible smoothing plate 30 is multi-layered. As shown in FIGS. 3-6, the flexible smoothing plate 30 includes a plurality of plates 35, 36, 37 that are provided as a stacked configuration. In the present embodiment, the flexible smoothing plate 30 includes a head plate 35, which abuts the lower frame member 26, a base plate 37 for contacting and smoothing a paving material during a paving operation, and an intermediate plate 36 that is sandwiched between the head plate 35 and the base plate 37. Although the present embodiment is illustrated with a multi-layered flexible smoothing plate 30 provided with three layers, within the scope of the present embodiment, a flexible smoothing plate may be provided with more than three plates or less than three plates, including, but not limited to, a lone plate.

According to one aspect of the present embodiment, the head plate 35 and intermediate plate 36 indirectly secures the base plate 37 to the lower frame member 26. As shown, the base plate 37 includes a plurality of retention studs 38*a*. The retention studs 38*a* extend upward through orifices 35*a*, and 36*a* formed in the head plate 35 and the intermediate plate 36 and cooperate with fasteners 39*a* to secure the base plate 37 to the head plate 35 and the intermediate plate 36. Also shown, the intermediate plate 36 includes a plurality of retention studs 38*b*. The retention studs 38*b* extend upward through orifices 26*b*, 35*b* in the lower frame member 26 and the head plate 35 and cooperate with fasteners 39*b* to secure the plates 35-37 to the lower frame member 26. The fasteners 39*a*, 39*b* may for example be locking collars or locking nuts. Advantageously, the present arrangement allows for the base plate to be removed and replaced by disassociating fasteners 39*a* from retention studs 38*a* and without removing the entire smoothing plate 30 or requiring access to the lower frame member 26, which may be difficult to access in the absence of additional disassembly of extension screed 20.

According to another aspect of the present embodiment, the flexible smoothing plate 30 of the extension screed 20 may be provide with a berm configuration 30*a* (FIGS. 5 and 6), whereat the outer longitudinal end 31 extends upward at an angle A relative to an inner portion 33. According to another aspect of the present embodiment, the flexible smoothing plate 30 of the extension screed 20 may be provided with a non-berm configuration 30*b* (FIGS. 3 and 4) whereat the outer longitudinal end 31 is substantially coplanar with the inner portion 33.

Figure 5:
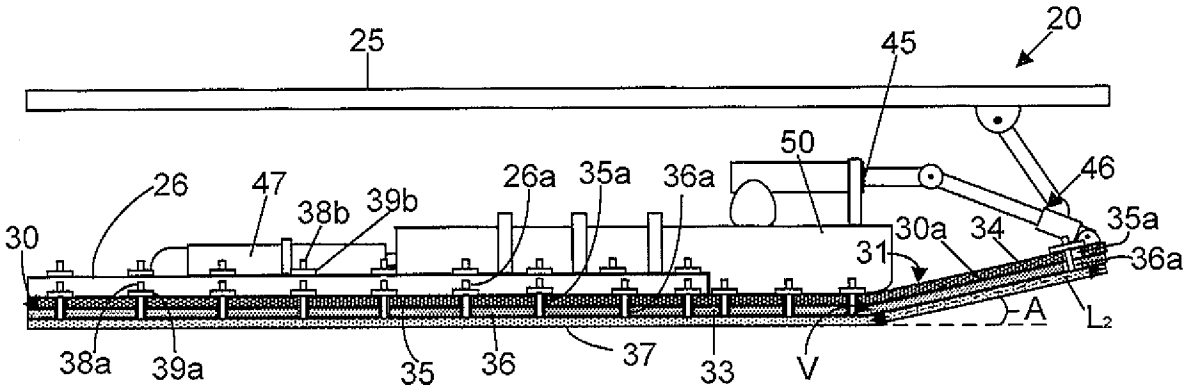
FIG. 5 depicts a side view of a screed extension, partially in section, in a berm configuration, according to one embodiment of the present invention.
Figure 6:
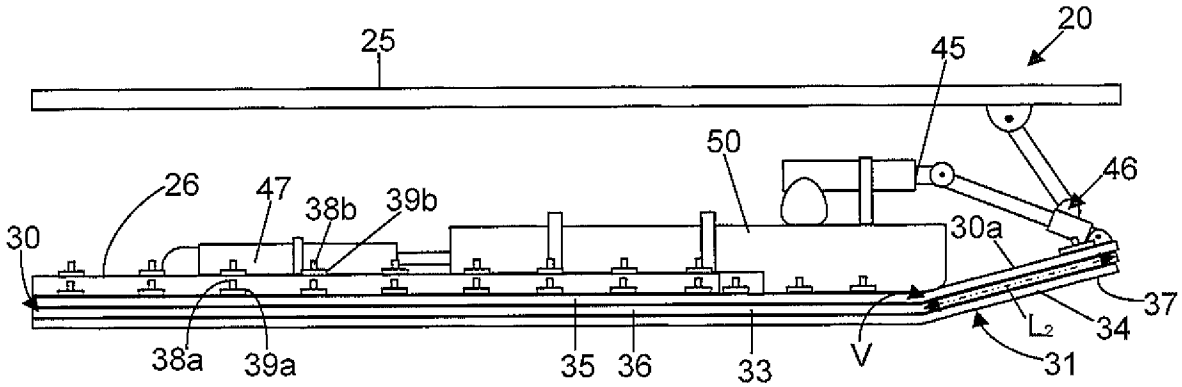
FIG. 6 depicts a side view of a screed extension in a berm configuration, according to one embodiment of the present invention.
Figure 7:
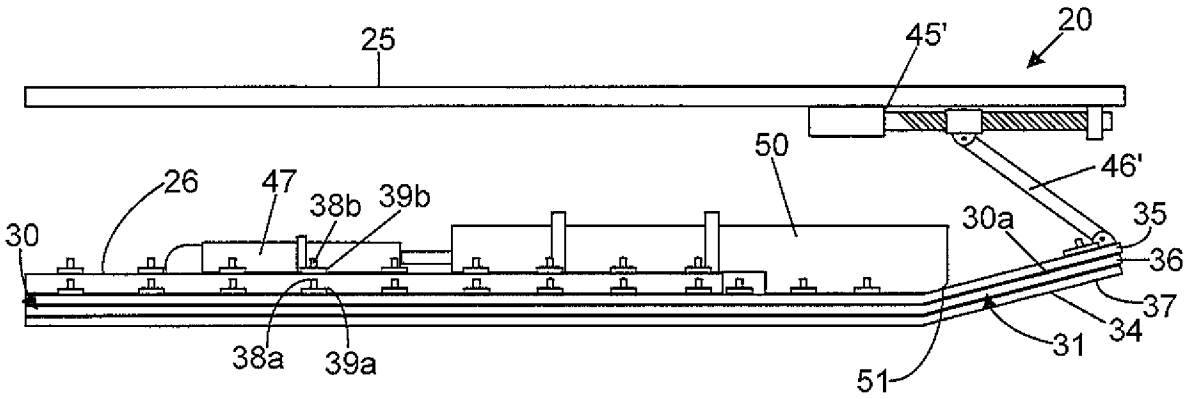
FIG. 7 depicts a side view of a screed extension in a berm configuration, according to one embodiment of the present invention.
Figure 8:
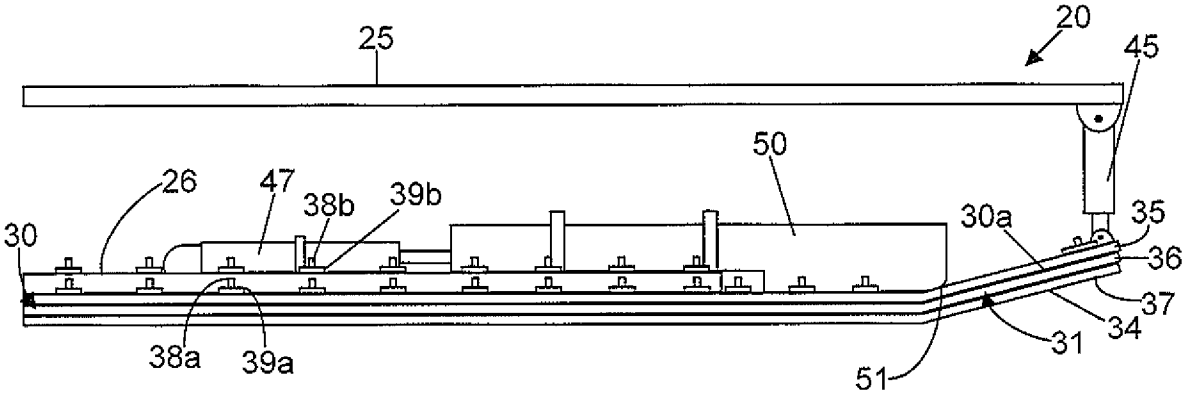
FIG. 8 depicts a side view of a screed extension in a berm configuration, according to one embodiment of the present invention.

As shown in FIGS. 3-6, the extension screed 20 includes a first actuator 45 connected to the outer longitudinal end 31. According to one aspect of the present embodiment, the first actuator 45 is adapted to selectively and preferably incrementally adjust the elevation of the outer longitudinal end 31 so that the outer longitudinal end 31 of the flexible smoothing plate 30 may form a berm 34 by flexing about a vertex block 50 and extending upward at an angle A relative to the inner portion 33 of the flexible smoothing plate 30, as shown in FIGS. 5 and 6. In the present embodiment, as shown in FIG. 5, the orifices 35*a*, and 36*a* located on the outer longitudinal end 31 are dimensioned to accommodate relative longitudinal displacement between the plates 35-37 as outer longitudinal end 31 flexes upward. The first actuator 45 may include a linkage 46 or 46' (FIG. 7) that connects the working end of the first actuator 45 to the outer longitudinal end 31; however, as shown in FIG. 8, the working end of the first actuator 45 may directly mount to the outer longitudinal end 31.

According to another aspect of the present embodiment, the extension screed 20 is configured so that when the extension screed 20 is in the berm configuration 30*a*, the length $L_2$ of the berm 34 on the outer longitudinal end 31 may be selectively and preferably incrementally adjusted. As FIGS. 3-6 illustrate, the extension screed 20 is provided with a second actuator 47 and vertex block 50. Also shown, the second actuator 47 is provided with a working end that is connected to the vertex block 50, whereby the vertex block 50 may translate along the length $L_1$ of the flexible smoothing plate 30. Advantageously, as shown by a comparison of FIG. 5 with FIG. 6, the second actuator 47 is adapted to selectively and preferably incrementally reposition the vertex block 50 along the longitudinal length $L_1$ of the flexible smoothing plate 30, whereby the vertex V of the berm 34 may be repositioned along the longitudinal length $L_1$ of the flexible smoothing plate 30 and the length $L_2$ of the berm 34 may be adjusted. As illustrated, to reduce wear, the vertex block 50 may be chamfered or rounded as at corner 51 where the vertex V of the berm 34 forms.

Although FIGS. 3-6 show first and second actuators 45, 47 in the form of linear actuator cylinders that allow slight incremental adjustments to the angle A of the berm, it is within the scope of the present embodiment to provide other types of actuator capable of adjusting the elevation of the outer longitudinal end and the position of the vertex block 50. By way of example, and not limitation, FIG. 7 shows a first actuator 45' in the form of a screw actuator. Additionally, although actuators that allow slight incremental adjustments are preferable, it is within the scope of the present embodiment to provide actuators that are capable of making adjustments by fixed incremental amounts.

Figure 9:
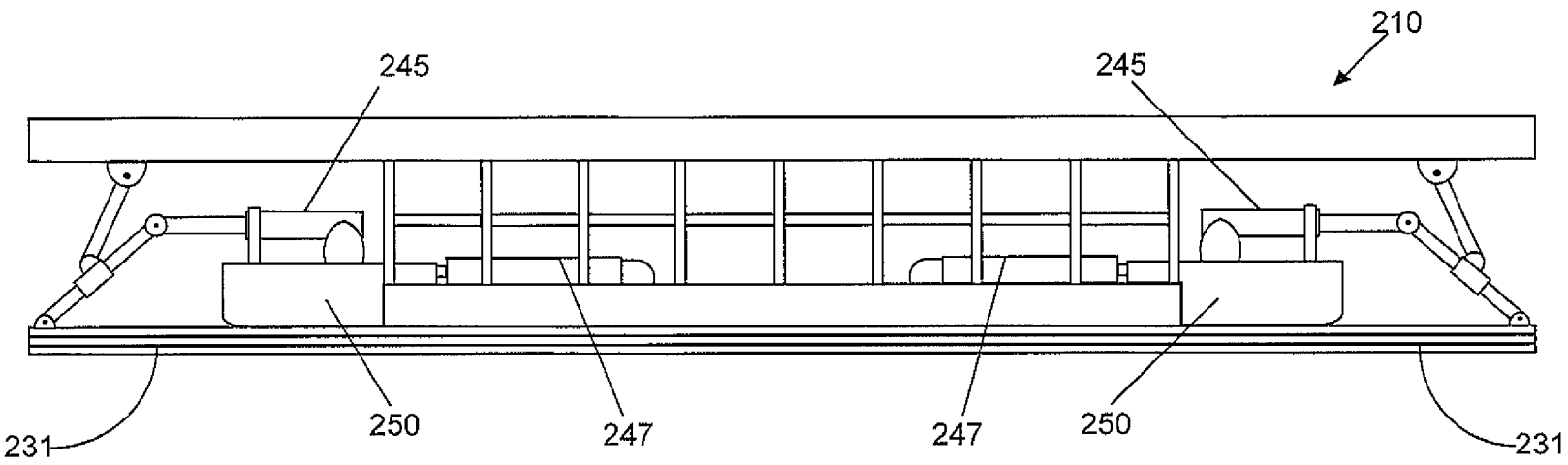
FIG. 9 depicts a main screed according to one embodiment of the present invention.

Turning now to FIG. 9, an alternative embodiment of the present invention is depicted. As shown therein, a main screed 210 according to one embodiment of the present invention is illustrated. Within the scope of the present embodiment, the main screed 210 may operate without or in conjunction with extension screeds, such as, for example, extension screeds 20, 120, 140. The main screed 210 is similar to the extension screed 20, except that it is provided with a pair of outer longitudinal ends 231, a pair of first actuators 245, a pair of second actuators 247, and a pair of vertex blocks 250. Those of ordinary skill in the art will appreciate that the main screed 210 operates in a similar manner as described in relation to the extension screed 20 shown in FIGS. 3-7, whereby both outer longitudinal ends 231 may be selectively provided with a berm.

The present description depicts specific examples to teach those skilled in the art how to make and use the best mode of the invention. The detailed descriptions of the above embodiments are not exhaustive descriptions of all embodiments contemplated by the inventors to be within the scope of the invention.

Persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention. Thus, although specific embodiments of, and examples for, the invention are described herein for illustrative purposes, various equivalent modifications are possible within the scope of the invention, as those skilled in the relevant art will recognize. Accordingly, the scope of the invention is determined from the appended claims and equivalents thereof.

I claim:

1. A screed for a paving machine, comprising:

a flexible smoothing plate provided with a longitudinal length and an outer longitudinal end;

a vertex block located on top of the flexible smoothing plate;

a first actuator connected to the outer longitudinal end and adapted to selectively adjust an elevation of the outer longitudinal end so that the outer longitudinal end of the flexible smoothing plate forms a berm provided with a length by flexing about the vertex block and extending upward at an angle relative to an inner portion of the flexible smoothing plate; and a second actuator connected to the vertex block that is configured to adjust the length of the berm by selectively repositioning the vertex block along the longitudinal length of the flexible smoothing plate.

2. The screed for a paving machine according to claim 1, wherein the flexible smoothing plate includes a plurality of plates that are provided as a stacked configuration.

3. The screed for a paving machine according to claim 1, further comprising a frame member, wherein:

the flexible smoothing plate includes a plurality of plates that are provided as a stacked configuration;

the plurality of stacked plates include a base plate and another plate;

the base plate includes a plurality of retention studs that extend upward through orifices in the another plate so that the retention studs secure the flexible smoothing plate to the another plate with the aid of fasteners; and the another plate includes another plurality of retention studs that extend upward thorough orifices in the frame member so that the another plurality of retention studs secure the another plate and the base plate to the frame member with the aid of fasteners.

4. The screed for a paving machine according to claim 1, further comprising a frame member, wherein:

the flexible smoothing plate includes a plurality of plates that are provided as a stacked configuration;

the plurality of stacked plates include a base plate and another plate;

the base plate includes a plurality of retention studs that extend upward through orifices in the another plate so that the retention studs secure the flexible smoothing plate to the another plate with the aid of fasteners;

the another plate includes another plurality of retention studs that extend upward thorough orifices in the frame member so that the another plurality of retention studs secure the another plate and the base plate to the frame member with the aid of fasteners; and the orifices on the another plate include an orifice located on the outer longitudinal end that is dimensioned to accommodate relative longitudinal displacement between the plurality of stacked plates as outer longitudinal end flexes upward.

5. The screed for a paving machine according to claim 1, wherein:

the flexible smoothing plate may be provided with a non-berm configuration, whereat the outer longitudinal end is substantially co-planar with the inner portion.

6. The screed for a paving machine according to claim 1, wherein the first actuator is a linear actuator that allows slight incremental adjustments to the angle of the berm.

7. The screed for a paving machine according to claim 1, wherein the second actuator is a linear actuator that allows slight incremental adjustments to a position of the vertex block.

8. The screed for a paving machine according to claim 1, further comprising:

another outer longitudinal end on the flexible smoothing plate;

another vertex block located on top of the flexible smoothing plate;

another first actuator connected to the another outer longitudinal end and adapted to selectively adjust an elevation of the another outer longitudinal end so that the another outer longitudinal end of the flexible smoothing plate forms a berm by flexing about the another vertex block and extending upward at an angle relative to the inner portion of the flexible smoothing plate; and another second actuator connected to the another vertex block and adapted to selectively reposition the another vertex block along the longitudinal length of the flexible smoothing plate in order to adjust the length of the berm.

9. A method for providing a berm configuration on a screed of a paving machine provided with a flexible smoothing plate that includes a longitudinal length and an outer longitudinal end, a vertex block located on top of the flexible smoothing place, a first actuator connected to the outer longitudinal end of the flexible smoothing plate, and a second actuator connected to the vertex block, comprising the steps of:

using the first actuator to selectively adjust an elevation of the outer longitudinal end so that the outer longitudinal end of the flexible smoothing plate forms a berm provided with a length by flexing about the vertex block and extending upward at an angle relative to an inner portion of the flexible smoothing plate; and using the second actuator to selectively reposition the vertex block along the longitudinal length of the flexible smoothing plate in order to adjust the length of the berm.

10. The method for providing a berm configuration on a screed of a paving machine according to claim 9, wherein the flexible smoothing plate includes a plurality of plates that are provided as a stacked configuration and the step of using the first actuator to selectively adjust the elevation of the outer longitudinal end so that the outer longitudinal end of the flexible smoothing plate forms the berm by flexing about the vertex block and extending upward at an angle relative to an inner portion of the flexible smoothing plate includes the step of flexing the plurality of plates about the vertex block.

11. The method for providing a berm configuration on a screed of a paving machine according to claim 9, further comprising a frame member, wherein:

the flexible smoothing plate includes a plurality of plates that are provided as a stacked configuration;

the plurality of stacked plates include a base plate and another plate;

the base plate includes a plurality of retention studs that extend upward through orifices in the another plate so that the retention studs secure the flexible smoothing plate to the another plate with the aid of fasteners;

the another plate includes another plurality of retention studs that extend upward thorough orifices in the frame member so that the another plurality of retention studs secure the another plate and the base plate to the frame member with the aid of fasteners; and the step of using the first actuator to selectively adjust the elevation of the outer longitudinal end so that the outer longitudinal end of the flexible smoothing plate forms the berm by flexing about the vertex block and extending upward at an angle relative to an inner portion of the flexible smoothing plate includes the step of flexing the plurality of plates about the vertex block.

12. The method for providing a berm configuration on a screed of a paving machine according to claim 9, further comprising a frame member, wherein:

the flexible smoothing plate includes a plurality of plates that are provided as a stacked configuration;

the plurality of stacked plates include a base plate and another plate;

the base plate includes a plurality of retention studs that extend upward through orifices in the another plate so that the retention studs secure the flexible smoothing plate to the another plate with the aid of fasteners;

the another plate includes another plurality of retention studs that extend upward thorough orifices in the frame member so that the another plurality of retention studs secure the another plate and the base plate to the frame member with the aid of fasteners;

the orifices on the another plate include an orifice located on the outer longitudinal end that is dimensioned to accommodate relative longitudinal displacement between the plurality of stacked plates as outer longitudinal end flexes upward; and the step of using the first actuator to selectively adjust the elevation of the outer longitudinal end so that the outer longitudinal end of the flexible smoothing plate forms the berm by flexing about the vertex block and extending upward at an angle relative to an inner portion of the flexible smoothing plate includes the step of flexing the plurality of plates about the vertex block.

13. The method for providing a berm configuration on a screed of a paving machine according to claim 9, further comprising the step of using the first actuator to selectively adjust the elevation of the outer longitudinal end so that the outer longitudinal end is provided with a non-berm configuration, whereat the outer longitudinal end is substantially co-planar with the inner portion.

14. The method for providing a berm configuration on a screed of a paving machine according to claim 9, wherein the first actuator is a linear actuator and further comprising the step of using the first actuator to make slight incremental adjustments to the angle of the berm.

15. The method for providing a berm configuration on a screed of a paving machine according to claim 9, wherein the second actuator is a linear actuator and further comprising the step of using the second actuator to make slight incremental adjustments to a position of the vertex block.

16. The method for providing a berm configuration on a screed of a paving machine according to claim 9, wherein the paving machine is provided with the flexible smoothing plate that includes another outer longitudinal end on the flexible smoothing plate, another vertex block located on top of the flexible smoothing plate, another first actuator connected to the another outer longitudinal end, and another second actuator connected to the another vertex block and further comprising the steps of:

using the another first actuator to selectively adjust an elevation of the another outer longitudinal end so that the another outer longitudinal end of the flexible smoothing plate forms a berm by flexing about the another vertex block and extending upward at an angle relative to the inner portion of the flexible smoothing plate; and using the another second actuator to selectively reposition the another vertex block along the longitudinal length of the flexible smoothing plate in order to adjust a length of the berm.

* * * * *